US007729642B2

(12) United States Patent
Matsumoto et al.

(10) Patent No.: US 7,729,642 B2
(45) Date of Patent: Jun. 1, 2010

(54) STRESS-REDUCEABLE TRANSPORT UNIT AND IMAGE FORMING APPARATUS USING THE SAME

(75) Inventors: Junichi Matsumoto, Yokohama city, Kanagawa (JP); Nobuo Iwata, Sagamihara city, Kanagawa (JP); Tomoyuki Ichikawa, Kawasaki city, Kanagawa (JP); Natsumi Katoh, Yokohama city, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 892 days.

(21) Appl. No.: 11/514,933

(22) Filed: Sep. 5, 2006

(65) Prior Publication Data

US 2007/0053721 A1 Mar. 8, 2007

(30) Foreign Application Priority Data

Sep. 5, 2005 (JP) ..... 2005-255784
Jun. 22, 2006 (JP) ..... 2006-172799

(51) Int. Cl.
*G03G 15/08* (2006.01)

(52) U.S. Cl. ..... 399/258; 399/259; 399/255

(58) Field of Classification Search ..... 399/258, 399/259, 255
See application file for complete search history.

(56) References Cited

U.S. PATENT DOCUMENTS 5,467,175 A 11/1995 Takagaki et al.
5,659,870 A * 8/1997 Takahara et al. ..... 399/359
5,884,126 A * 3/1999 Schoch et al. ..... 399/258
6,067,431 A * 5/2000 Bakker ..... 399/252
6,163,669 A 12/2000 Aoki et al.
6,295,437 B1 9/2001 Hodoshima et al.
6,608,984 B1 8/2003 Matsumoto et al.
6,628,913 B2 9/2003 Matsumoto et al.
6,816,695 B2 11/2004 Nakai et al.
2003/0198487 A1 * 10/2003 Yanagisawa et al. ..... 399/258
2005/0013633 A1 * 1/2005 Harumoto ..... 399/258
2005/0095037 A1 5/2005 Koike et al.
2005/0163537 A1 * 7/2005 Muramatsu et al. ..... 399/258

(Continued)

FOREIGN PATENT DOCUMENTS

JP 7-175313 7/1995

(Continued)

OTHER PUBLICATIONS

U.S. Appl. No. 12/178,986, filed Jul. 24, 2008, Matsumoto, et al.

(Continued)

*Primary Examiner*—David M Gray
*Assistant Examiner*—Rodney Bonnette
(74) *Attorney, Agent, or Firm*—Oblon, Spivak, McClelland, Maier & Neustadt, L.L.P.

(57) ABSTRACT

An agent transport unit for transporting an agent from a first container to a second container includes a transport route and a pump. The transport route connects the first container and second container, and includes at least one of a first route, a second route, and a third route. The first route extends in a substantially horizontal direction, the second route extends in a substantially vertical direction, and the third route extends in a substantially inclined direction with a repose angle equal to or less than that of the agent. The pump supplies a gas flow into the transport route to transport the agent in the transport route.

20 Claims, 10 Drawing Sheets

U.S. PATENT DOCUMENTS

| | | | |
|---|---|---|---|
| 2005/0265759 | A1 | 12/2005 | Takeuchi et al. |
| 2005/0281592 | A1 | 12/2005 | Muramatsu et al. |

FOREIGN PATENT DOCUMENTS

| | | |
|---|---|---|
| JP | 10-274883 | 10/1998 |
| JP | 2001-183893 | 7/2001 |
| JP | 2001-194860 | 7/2001 |
| JP | 2002-214840 | 7/2002 |
| JP | 2004-226851 | 8/2004 |
| JP | 2005-17787 | 1/2005 |
| JP | 2005-37438 | 2/2005 |

OTHER PUBLICATIONS

U.S. Appl. No. 12/256,998, filed Oct. 23, 2008, Iwata et al.
U.S. Appl. No. 11/748,726, filed May 15, 2007, Iwata, et al.
U.S. Appl. No. 11/751,163, filed May 21, 2007, Katoh, et al.
U.S. Appl. No. 12/126,441, filed May 23, 2008, Matsumoto, et al.
U.S. Appl. No. 12/129,961, filed May 30, 2008, Katoh, et al.
U.S. Appl. No. 12/130,092, filed May 30, 2008, Ohmura, et al.

* cited by examiner

STRESS-REDUCEABLE TRANSPORT UNIT AND IMAGE FORMING APPARATUS USING THE SAME

TECHNICAL FIELD

The present disclosure generally relates to an image forming apparatus having an agent transport unit, which transports an agent from a first container to a second container.

BACKGROUND

Conventionally, an image forming apparatus using electrophotography (e.g., copying machine, printer, facsimile, and multi-functional apparatus) includes a developing unit, which uses a two-component developing agent composed of toners and carriers (and additives, as required), for example.

In such image forming apparatus, fresh agent such as toner and carrier is supplied to the developing unit, as required, with a method called trickle developing method.

In general, when toners are consumed by image forming operations, fresh toners are supplied to the developing unit through a toner supply port of the developing unit, as required.

An agitation member such as transport screw agitatingly mixes such fresh toners, supplied into the developing unit, with a developing agent in the developing unit.

Then, such agitatingly mixed developing agent is supplied to a developing roller. The developing agent carried-up on the developing roller may be regulated to a given amount by a doctor blade.

Toners in such two-component developing agent adhere a latent image formed on a photoconductive drum when the developing roller comes to a developing area, at which the developing roller and photoconductive drum face each other.

In such developing process, carriers in the two-component developing agent may not be consumed during the developing process but remains in the developing unit, by which such carriers may degrade its property over the time due to several factors such as stress received by an agitation movement in the developing unit.

Specifically, a coating layer on carrier may be abraded or peeled off due to agitation and mixing of carriers in the developing unit for a longer period of time, which may lead to a degradation of charge-ability of carriers (so called "peel-off" phenomenon), or toners and additives may adhere on surface of carriers, which may lead to a degradation of charge-ability of carriers (so called "spent" phenomenon).

The above-mentioned trickle developing method may be used to prevent an image quality degradation of a printed image caused by aging (or degradation) of carriers.

Specifically, fresh carriers (or fresh two-component developing agent) are supplied into the developing unit, as required, and a part of two-component developing agent used in the developing unit is ejected to an outside of the developing unit, as required, to reduce an amount of degraded carriers in the developing unit. With such method, the amount of carriers and charge-ability of carriers in the developing unit may be maintained at a preferable level.

An image forming apparatus using such trickle developing method may stabilize an image quality of printed image over the time compared to another image forming apparatus, which requires a replacement of developing unit or carriers to a new one whenever an aging (or degradation) of carriers may occur.

One related image forming apparatus, using a trickle developing method, includes a carrier container, a developing unit, and a transport route extended from the carrier container to the developing unit. Fresh carriers in the carrier container are transported to the developing unit through the transport route, which has a coil screw (or transport screw) therein.

Specifically, such coil screw, provided inside the transport route (e.g., tube) connecting the carrier container and the developing unit, can transport carriers with mechanical (or physical) transportability of coil screw.

As for such image forming apparatus, even if the carrier container and the developing unit are distanced apart with each other, carriers may be transported with mechanical (or physical) transportability of coil screw.

However, such coil screw may not be used for a transport route having a complexed bending portion or a transport route that extends from a lower position to a higher position (e.g., vertical or inclined route) because carries have to move in a upward direction in the vertical or inclined route against gravity effect, which acts on carries toward a downward direction.

Therefore, an agent transport unit having coil screw may restrict a freedom of space layout in an image forming apparatus.

Furthermore, fresh carriers may receive mechanical (or physical) stress from the coil screw when the coil screw transports the fresh carriers, and thereby a coating layer on such fresh carriers may be abraded or peeled off, which is not a favorable phenomenon.

Another related image forming apparatus, using a trickle developing method, includes a toner transport unit, which transports toners stored in a toner container to a developing unit with a screw pump (e.g., mohno-pump).

Such toner transport unit connects the toner container and the developing unit with a transport route made of flexible tube, by which a freedom of space layout in the image forming apparatus may be improved.

A pump such as air pump and screw pump may transport carriers by supplying a gas flow (e.g., airflow) in the transport route, which connects the carrier container and the developing unit, without causing mechanical (or physical) stress to carriers.

Even in such configuration, a smooth transportation of carriers through the transport route (e.g., transport tube) may be degraded, and the carriers may clog or stagnate the transport route (e.g., transport tube).

If carriers clog or stagnate the transport route (e.g., transport tube), the transport route may be choked at such clogging or stagnating portion, by which the carriers may not be effectively supplied to the developing unit.

Similarly, such drawback may occur when transporting toner or a two-component developing agent in a transport route.

SUMMARY

The present disclosure relates to an agent transport unit for transporting an agent from a first container to a second container. The agent transport unit includes a transport route and a pump. The transport route connects the first container and second container, and includes at least one of a first route, a second route, and a third route. The first route extends in a substantially horizontal direction, the second route extends in a substantially vertical direction, and the third route extends in a substantially inclined direction with a repose angle equal to or less than that of the agent. The pump supplies a gas flow into the transport route to transport the agent in the transport route.

The present disclosure also relates to an image forming apparatus including a first container, a second container, a transport route, and a pump. The first container stores an agent. The second container receives the agent. The transport route connects the first container and second container, and includes at least one of a first route, a second route, and a third route. The first route extends in a substantially horizontal direction, the second route extends in a substantially vertical direction, and the third route extends in a substantially inclined direction with a repose angle equal to or less than that of the agent. The pump supplies a gas flow into the transport route to transport the agent in the transport route.

The present disclosure also relates to a method of transporting an agent from a first container to a second container through a transport route. The method includes the steps of satisfying, supplying, placing, transporting, counting, and stopping. The satisfying step satisfies a condition of supplying the agent to the second container. The supplying step supplies a gas flow into the transport route. The placing step places the agent in the transport route from the first container. The transporting step transports the agent in the transport route with the gas flow. The counting step counts a time period for transporting the agent from the first container to the second container. The stopping step stops a supply of the gas flow into the transport route. The transport route includes at least one of a first route extending in a substantially horizontal direction, a second route extending in a substantially vertical direction, and a third route, extending in a substantially inclined direction, configured to incline with a repose angle equal to or less than that of the agent.

BRIEF DESCRIPTION OF THE DRAWINGS

A more complete appreciation of the disclosure and many of the attendant advantages and features thereof can be readily obtained and understood from the following detailed description with reference to the accompanying drawings, wherein.

DETAILED DESCRIPTION OF EXEMPLARY EMBODIMENTS

Figure 1:
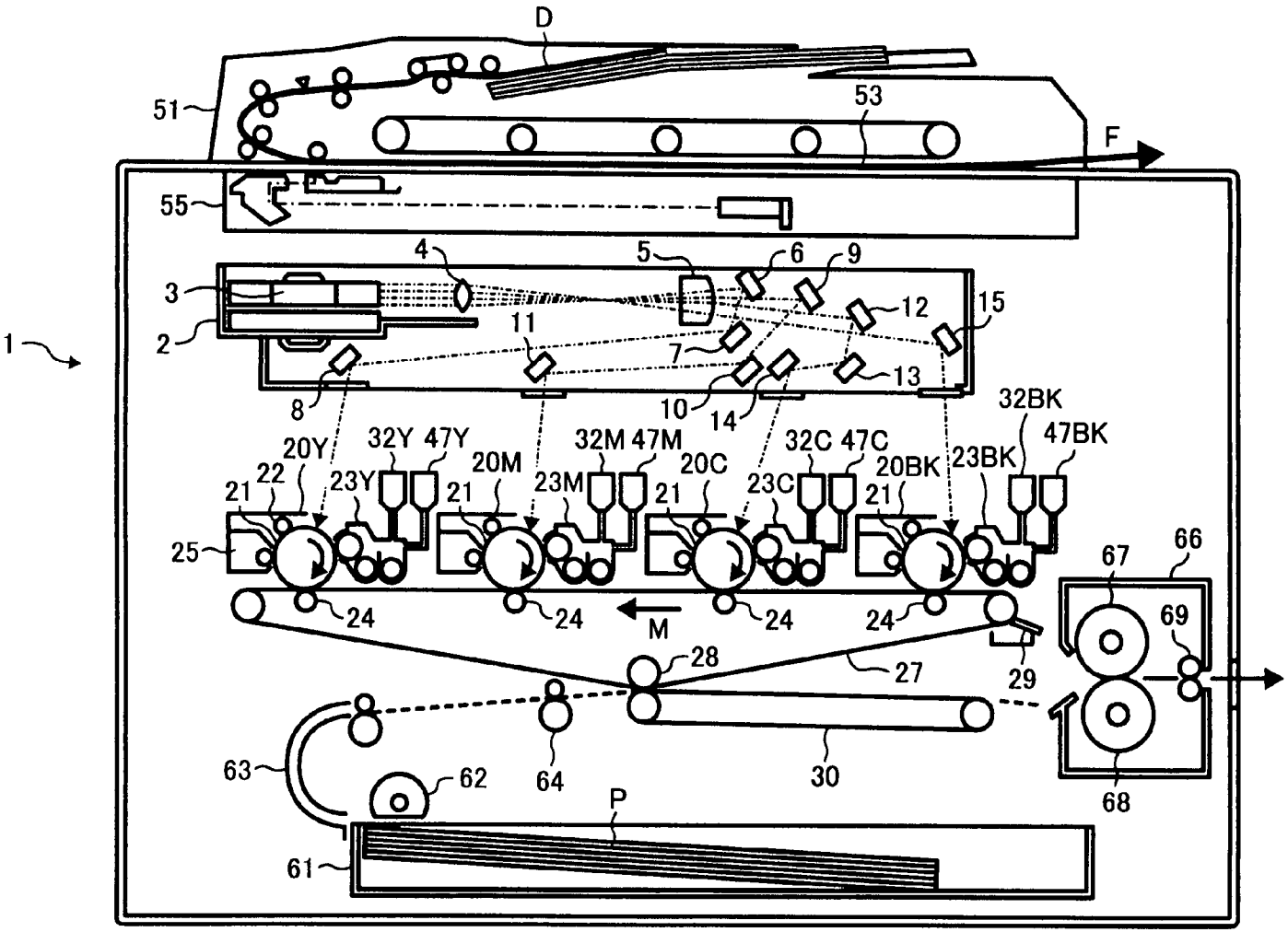
FIG. 1 is a schematic view of an image forming apparatus according to an exemplary embodiment.

In describing exemplary embodiments shown in the drawings, specific terminology is employed for the sake of clarity. However, the disclosure of this present invention is not intended to be limited to the specific terminology so selected and it is to be understood that each specific element includes all technical equivalents that operate in a similar manner.

Referring now to the drawings, wherein like reference numerals designate identical or corresponding parts throughout the several views, an image forming apparatus according to an exemplary embodiment is described with particular reference to FIG. 1.

In this disclosure, a "developing agent" means any one of "carrier," "toner," and "two-component developing agent having carrier and toner" used for developing process, and each term is used in the following description, as required.

As shown in FIG. 1, an image forming apparatus 1 includes an optical writing unit 2, process cartridges 20Y, 20M, 20C, 20BK, a photoconductive drum 21, a charger 22, developing units 23Y, 23M, 23C, 23BK, a primary transfer roller 24, a cleaning unit 25, an intermediate transfer belt 27, a secondary transfer roller 28, a belt cleaning unit 29, a transport belt 30, toner supply units 32Y, 32M, 32C, 32BK, carrier supply units 47Y, 47M, 47C, 47BK, a document feeder 51, a scanner 55, a sheet feed unit 61, and a fixing unit 66.

The optical writing unit 2 emits a laser beam based on input image information.

Each of the process cartridges 20Y, 20M, 20C, and 20BK corresponds to a process cartridge for producing yellow, magenta, cyan, and black image respectively.

The respective photoconductive drum 21 functions as image carrying member for process cartridges 20Y, 20M, 20C, and 20BK. The charger 22 charges a surface of the photoconductive drum 21 uniformly.

Each of the developing units 23Y, 23M, 23C, and 23BK develops an electrostatic latent image formed on the respective photoconductive drum 21 as toner image.

The primary transfer roller 24 transfers the toner image from the photoconductive drum 21 to the intermediate transfer belt 27.

The cleaning unit 25 recovers toners remained on the photoconductive drum 21 after the toner image is transferred from the photoconductive drum 21 to the intermediate transfer belt 27.

The intermediate transfer belt 27 receives a plurality of toner images from the process cartridges 20Y, 20M, 20C, and 20BK.

The secondary transfer roller 28 transfers the toner images from the intermediate transfer belt 27 to a recording medium P.

The belt cleaning unit 29 recovers toners which remain on the intermediate transfer belt 27 after the toner images are transferred from the intermediate transfer belt 27 to the recording medium P.

The transport belt 30 transports the recording medium P having the toner images thereon.

Each of the toner supply units 32Y, 32M, 32C, and 32BK supplies respective color toner to each of the developing units 23Y, 23M, 23C, and 23BK, respectively, as required.

Each of the carrier supply units 47Y, 47M, 47C, and 47BK supplies fresh carriers to each of the developing units 23Y, 23M, 23C, and 23BK, respectively, as required.

The document feeder 51 feeds a document D to the scanner 55. The scanner 55 scans image information on the document D.

The sheet feed unit 61 stores the recording medium P such as transfer sheet.

The fixing unit 66 fixes toner images on the recording medium P.

Each of the process cartridges 20Y, 20M, 20C, and 20BK can integrate the photoconductive drum 21, charger 22, and cleaning unit 25, for example.

In each of the process cartridges 20Y, 20M, 20C, and 20BK, image forming of a yellow, magenta, cyan, and black image is respectively conducted on the respective photoconductive drum 21.

Hereinafter, a color image forming operation in the image forming apparatus 1 is explained.

The document D placed on a document tray of the document feeder 51 is transported in a direction shown by an arrow F in FIG. 1 with transport rollers, and placed on a contact glass 53 of the scanner 55.

The scanner 55 optically scans image information of the document D placed on the contact glass 53.

Specifically, the scanner 55 scans a light beam, generated at a light source, to an image on the document D placed on the contact glass 53.

A light reflected from the document D is focused onto a color sensor (not shown) via mirrors and lenses.

The color sensor reads color image information of the document D as RGB (i.e., red, green, and blue) information, and then converts RGB information to electric signals.

Based on the electric signals for RGB information, an image processor (not shown) conducts various processes such as color converting process, color correction process, and spatial frequency correction process to obtain color image information of yellow, magenta, cyan, and black.

The color image information of yellow, magenta, cyan, and black are transmitted to the optical writing unit 2.

Then, the optical writing unit 2 emits a laser beam corresponding to the color image information of yellow, magenta, cyan, and black to the respective photoconductive drum 21 in the process cartridges 20Y, 20M, 20C, and 20BK.

The photoconductive drum 21 rotates in a clockwise direction in FIG. 1.

The charger 22 uniformly charges a surface of the photoconductive drum 21 to form a charge potential on the photoconductive drum 21.

When the charged surface of photoconductive drum 21 comes to a laser beam irradiation position, the optical writing unit 2 emits a laser beam corresponding to each color of yellow, magenta, cyan, and black.

As shown in FIG. 1, the laser beam reflected at a polygon mirror 3 passes lenses 4 and 5, and then follows a separate light path for each color of yellow, magenta, cyan, and black.

A laser beam for yellow component, reflected on mirrors 6 to 8, irradiates a surface of the photoconductive drum 21 in the process cartridge 20Y as shown in FIG. 1.

The laser beam for yellow component can be scanned in a main scanning direction of the photoconductive drum 21 with a rotation of the polygon mirror 3, rotating at a high speed.

As such, an electrostatic latent image for yellow component is formed on the photoconductive drum 21.

In a similar way, a laser beam for magenta component, reflected on mirrors 9 to 11, irradiates a surface of the photoconductive drum 21 in the process cartridge 20M as shown in FIG. 1, and an electrostatic latent image for magenta component is formed on the photoconductive drum 21.

In a similar manner, a laser beam for cyan component, reflected on mirrors 12 to 14, irradiates a surface of the photoconductive drum 21 in the process cartridge 20C as shown in FIG. 1, and an electrostatic latent image for cyan component is formed on the photoconductive drum 21.

In a similar way, a laser beam for black component reflected on a mirror 15 irradiates a surface of the photoconductive drum 21 in the process cartridge 20BK as shown in FIG. 1, and an electrostatic latent image for black is formed on the photoconductive drum 21.

Then, each of the electrostatic latent images on the respective photoconductive drum 21 comes to a position facing each of the developing units 23Y, 23M, 23C, and 23BK.

Each of the developing units 23Y, 23M, 23C, and 23BK supplies respective color toner (i.e., yellow, magenta, cyan, and black) to the respective photoconductive drum 21 to develop a respective toner image on the respective photoconductive drum 21.

After the developing process, the photoconductive drum 21 comes to a position facing the intermediate transfer belt 27.

As shown in FIG. 1, four primary transfer rollers 24, provided at inner face of the intermediate transfer belt 27, face the respective photoconductive drum 21 via the intermediate transfer belt 27.

The four primary transfer rollers 24 transfer toner images on the respective photoconductive drum 21 to the intermediate transfer belt 27 by superimposing toner images on the intermediate transfer belt 27.

Then, the photoconductive drum 21 comes to a position facing the cleaning unit 25. The cleaning unit 25 recovers toners which remain on the photoconductive drum 21.

Then, a de-charger (not shown) de-charges the photoconductive drum 21 to prepare for a next image forming operation on the photoconductive drum 21.

The intermediate transfer belt 27 having toner images thereon travels in a direction shown by an arrow M in FIG. 1, and comes to the position of the secondary transfer roller 28.

At the secondary transfer roller 28, the toner images are transferred from the intermediate transfer belt 27 to the recording medium P.

Then, the intermediate transfer belt 27 comes to a position facing the belt cleaning unit 29. The belt cleaning unit 29 recovers toners which remain on the intermediate transfer belt 27.

Then, a transfer process for intermediate transfer belt 27 has completed.

The recording medium P is transported to the position of the secondary transfer roller 28 from the sheet feed unit 61 via a transport guide 63 and registration roller 64.

Specifically, the recording medium P such as transfer sheet in the sheet feed unit 61 is fed to the transport guide 63 by a feed roller 62, and further fed to the registration roller 64.

The registration roller 64 feeds the recording medium P to the position of the secondary transfer roller 28 by synchronizing a feed timing with toner-image formation timing on the intermediate transfer belt 27.

Then, the recording medium P having the toner images thereon is transported to the fixing unit 66 by the transport belt 30.

The fixing unit 66 includes a heat roller 67 and a pressure roller 68 as shown in FIG. 1. The fixing unit 66 fixes the toner images on the recording medium P at a fixing nip between the heat roller 67 and pressure roller 68.

After fixing the toner images on the recording medium P, the recording medium P is ejected from the image forming apparatus 1 by an ejection roller 69.

Then, an image forming process of one cycle has completed.

Hereinafter, an image forming section of the image forming apparatus 1 is explained with reference to FIGS. 2 and 3.

Figure 2:
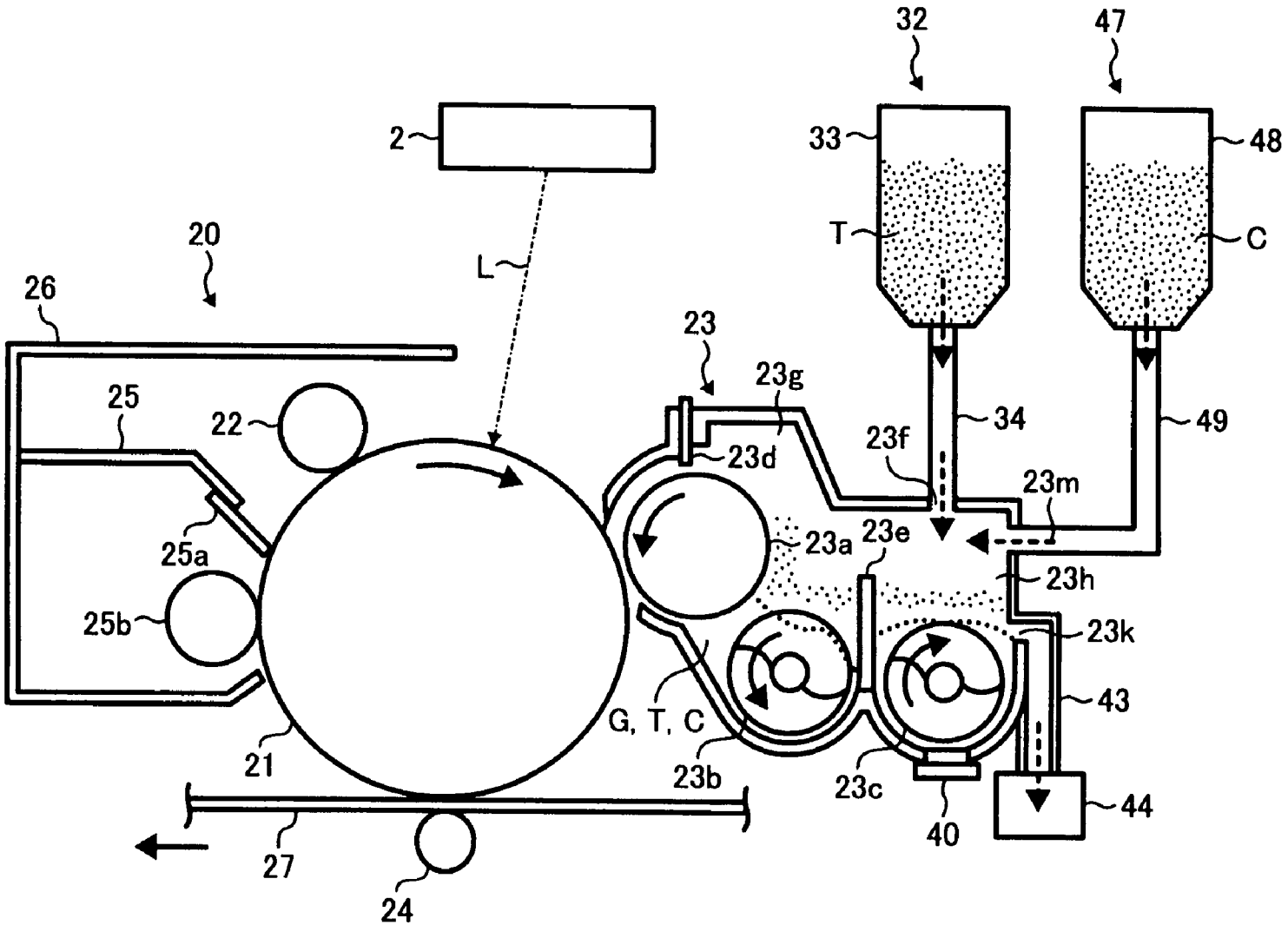
FIG. 2 is a schematic view of an image forming section in an image forming apparatus in FIG. 1.

FIG. 2 is a schematic view of an image forming section in the image forming apparatus 1. FIG. 3 is a schematic cross-sectional view explaining an arrangement of the transport screws in the developing unit 23.

The image forming apparatus 1 includes four image forming sections for image forming process. Because the four image forming sections take similar configuration except a color of toner T, reference characters of Y, M, C, and BK for process cartridges, developing units, and toner supply units or other parts are omitted from FIGS. 2 and 3.

In FIG. 2, configurations for the carrier supply unit 47 and toner supply unit 32 are simplified for the sake of explanation.

As shown in FIG. 2, the process cartridge 20 includes the photoconductive drum 21 as image carrying member, the charger 22, and the cleaning unit 25, which are encased in a case 26.

The cleaning unit 25 includes a cleaning blade 25*a* and a cleaning roller 25*b*, which are contactable to the photoconductive drum 21 as shown in FIG. 2.

The developing unit 23 includes a developing roller 23*a*, a first transport screw 23*b*, a second transport screw 23*c*, and a doctor blade 23*d* as shown in FIG. 2.

As shown in FIG. 2, the developing roller 23*a* faces the photoconductive drum 21.

The first transport screw 23*b* faces the developing roller 23*a*, and also faces the second transport screw 23*c* via a separator 23*e* provided between the first transport screw 23*b* and second transport screw 23*c* as shown in FIG. 2.

The doctor blade 23*d* faces the developing roller 23*a* as shown in FIG. 2.

Figure 3:
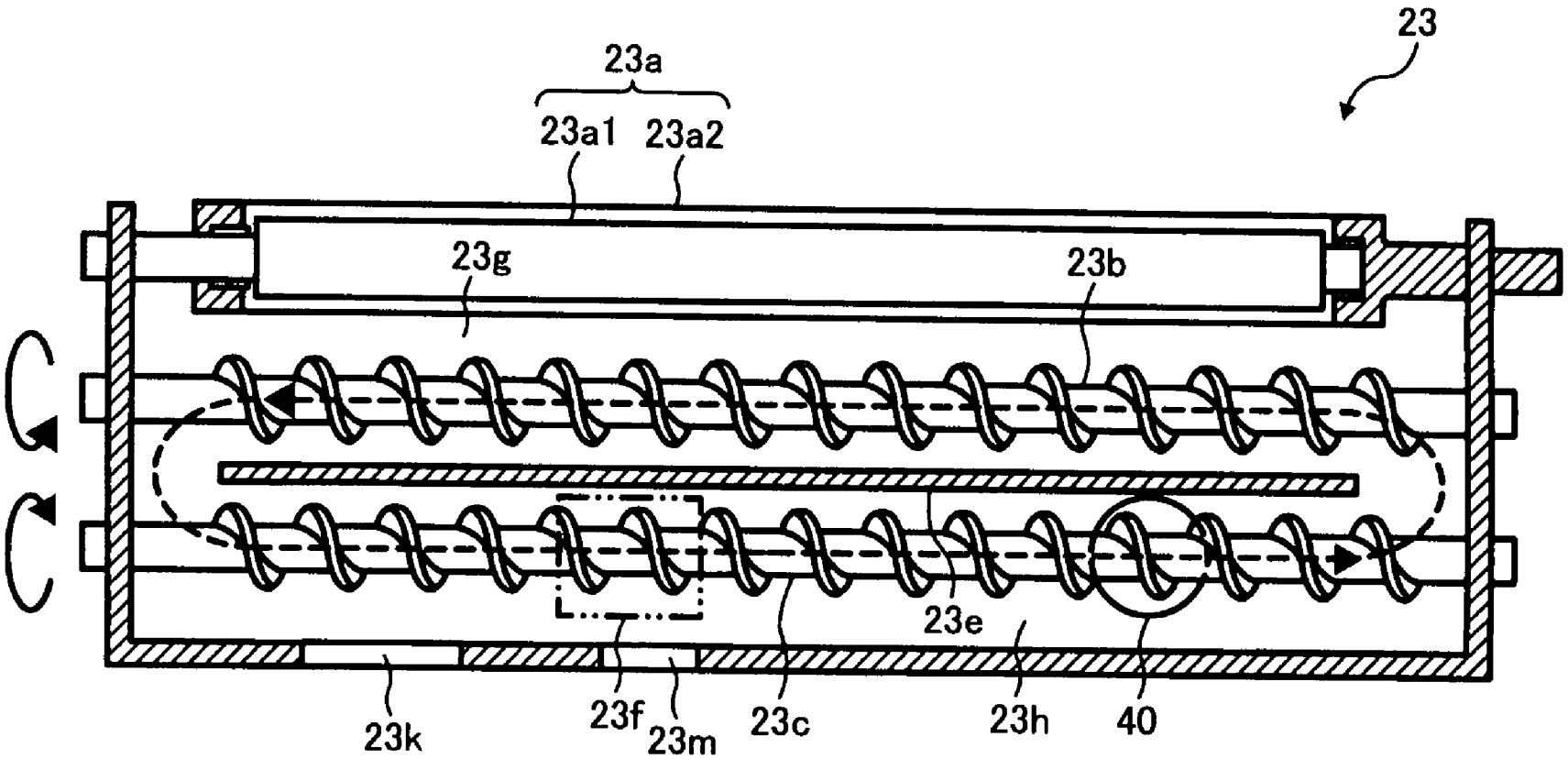
FIG. 3 is a schematic cross-sectional view explaining an arrangement of transport screws in a developing unit.

The developing unit 23 includes a first agent compartment 23*g* and a second agent compartment 23*h*, separated by the separator 23*e* as shown in FIGS. 2 and 3.

As shown in FIG. 3, the first agent compartment 23*g* and second agent compartment 23*h* are connected each other at an opening provided on both end portion of the separator 23*e* to circulate the developing agent in the developing unit 23.

The first agent compartment 23*g* includes the developing roller 23*a*, first transport screw 23*b*, and doctor blade 23*d* as shown in FIG. 2.

The second agent compartment 23*h* includes the second transport screw 23*c*, and a magnetic sensor 40 as shown in FIG. 2.

As shown in FIG. 3, the developing roller 23*a* includes a magnet 23*a*1, and a sleeve 23*a*2.

The magnet 23*a*1 is provided inside the sleeve 23*a*2, and generates magnetic poles over the developing roller 23*a*. The sleeve 23*a*2, made of non-magnetic material, can rotate around the magnet 23*a*1.

The magnet 23*a*1 generates a plurality of magnetic poles over the sleeve 23*a*2 of the developing roller 23*a* such as main pole, transport pole, carrying-up pole, and agent release pole.

The developing roller 23*a* (or sleeve 23*a*2) is connected to a drive motor (not shown) in the image forming apparatus 1, and can be rotated by the drive motor (not shown).

Although not shown in FIG. 3, the developing roller 23*a*, first transport screw 23*b*, and second transport screw 23*c* can be connected each other by a gear system (not shown). Accordingly, when the drive motor rotates the developing roller 23*a*, the first transport screw 23*b* and second transport screw 23*c* can also be rotated via the gear system (not shown).

As shown in FIG. 2, the developing unit 23 contains a two-component developing agent G having a toner T and carrier C (i.e., magnetic component), for example.

In an exemplary embodiment, the toner T of the developing agent G includes a toner particle, made of resin and colorant, and additives, for example.

The toner T can be made by several methods such as a polymerization reaction of monomers (e.g., emulsion polymerization, suspension polymerization), a levigation of resin with melting and spraying of resin, and an adhering of additives to toner particles, dispersed in water, by mixing them with Henschel mixer or the like.

Resins for use in toner T includes homopolymer and copolymer of styrene (e.g., polystyrene, polychlorostyrene, polyvinyltoluene) and derivative substitution of styrene; styrene copolymer such as styrene/p-chlorostyrene copolymer, styrene/propylene copolymer, styrene/vinyltoluene copolymer, styrene/vinylnaphthalene copolymer, styrene/methyl acrylate copolymer, styrene/ethyl acrylate copolymer, styrene/butyl acrylate copolymer, styrene/octyl acrylate copolymer, styrene/methyl methacrylate copolymer, styrene/ethyl methacrylate copolymer, styrene/butyl methacrylate copolymer, styrene/α-chlormethyl methacrylate copolymer, styrene/acrylonitrile copolymer, styrene/vinylmethylether copolymer, styrene/vinylethylether copolymer, styrene/vinylmethylketone copolymer, styrene/butadiene copolymer, styrene/isoprene copolymer, styrene/acrylonitrile/indene copolymer, styrene/maleic acid copolymer, styrene/maleate ester copolymer; polymethyl methacrylate, polybutylmethacrylate , polyvinyl chloride, polyvinyl acetate, polyethylene, polypropylene, polyester, polyvinylbutylbutyral, polyacrylic resin, rosin, modified rosin, terpene resin, phenol resin, aliphatic or alicyclic hydrocarbon resin, aromatic resin, chlorinated paraffin, and paraffin wax, for example. These resins can be used alone or as a mixture of at least two resins for toner T.

A colorant for black toner includes carbon black, aniline black, furnace black, and lamp black, for example.

A colorant for cyan toner includes phthalocyanine blue, methylene blue, victoria blue, methyl violet, aniline blue, and ultramarine blue, for example.

A colorant for magenta toner includes rhodamine 6G lake, dimethylquinacridone, watching red, rose bengal, rhodamine B, and alizarin lake, for example.

A colorant for yellow toner includes chrome yellow, benzidine yellow, hansa yellow, naphthol yellow, molybdenum orange, quinoline yellow, and tartrazine, for example.

The toner T may include a small amount of charge-adding agent (e.g., pigment, polarity control agent) to add an effective chargeability to toner T.

The polarity control agent includes a metal complex of monoazo acid dye, nitrohumic acid and the salt thereof, a metal-complex (e.g., Co, Cr, Fe) of several acids such as salicylic acid, naphthoic acid, and dicarboxylic acid, organic dye, and quaternary ammonium salt, for example.

Inorganic fine particles used for additives include silica, alumina, titanium oxide, barium titanate, magnesium titanate, calcium titanate, strontium titanate, ferric oxide, copper oxide, zinc oxide, tin oxide, silica sand, clay, mica isinglass, sand-lime, kieselgur, chrome oxide, cerium oxide, colcothar, antimony trioxide, magnesium oxide, zirconium oxide, barium sulfate, barium carbonate, calcium carbonate, silicon carbide, and silicon nitride, for example.

Among these compounds, silica and titanium oxide may favorably prevent submerging of additives in toner, and may improve chargeability of toner.

In an exemplary embodiment, the carrier C, which is in the two-component developing agent G and the carrier cartridge 48, includes a core particle made of magnetic material, and a coating layer formed on the core particle.

The core particle of carrier C includes ferromagnetic material such as iron, cobalt, and nickel, and an alloy or compound of magnetite, hematite, and ferrite, for example.

The coating layer of the carrier C can be made of polyolefin resin such as polyethylene, polypropylene, chlorinated polyethylene, and chlorosulfonated polyethylene; polyvinyl and polyvinylidene resin such as polystyrene, acrylic resin (e.g., polymethyl methacrylate), polyacrylonitrile, polyvinylacetate, polyvinylalcohol, polyvinylbutyral, polyvinyl chloride, polyvinylcarbazole, polyvinylether and polyvinylketone; copolymer of polyvinyl chloride/vinyl acetate; copolymer of styrene/acrylic acid; silicon resin made of organosiloxane and its modified compound (e.g., modified compound of alkyd resin, polyester, epoxy resin, polyurethane); fluorine resin such as polytetrafluoroethylene, polyvinyl fluoride, polyvinylidene fluoride, polychlorotrifluoroethylene; polyamide; polyester such as polyethyleneterephthalate; polyurethane; polycarbonate; amino resin such as urea/formaldehyde resin; and epoxy resin, for example.

Among these resins, acrylic resin, silicon resin, modified compound of acrylic resin or silicon resin, and fluorine resin are preferable to prevent so called "spent" phenomenon, and silicon resin or a modified compound of silicon resin are more preferable to prevent the "spent" phenomenon.

The coating layer can be coated on the core particle by spraying a resin solution on a surface of core particle, or by immersing the core particle in resin solution.

The carrier C may also include fine particles in the coating layer to adjust electrical resistance of the carrier C.

The fine particles dispersed in the coating layer preferably have a particle diameter of 0.01 μm to 5.0 μm, for example.

The fine particles of 2 to 30 weight part is preferably added with a resin of 100 weight part, and more preferably 5 to 20 weight part are added with a resin of 100 weight part.

The fine particles include silica, metal oxides (e.g. alumina, titania), and pigment (e.g., carbon black), for example.

Hereinafter, a developing process in the image forming process is explained with reference to FIGS. 2 and 3.

The developing roller 23*a* rotates in a direction shown by an arrow in FIG. 2.

As shown in FIG. 3, the first transport screw 23*b* and second transport screw 23*c* rotate in a respective direction shown by an arrow in FIG. 2.

Accordingly, when the toner T (i.e., fresh toner) is supplied to the developing unit 23 from the toner supply unit 32 through a toner supply port 23*f*, the developing agent G in the developing unit 23 is agitatingly mixed with the toner T (i.e., fresh toner) and circulated in a direction shown by an dotted arrow line shown in FIG. 3.

The first transport screw 23*b* transports the developing agent G in one direction (from right to left in FIG. 3), and the second transport screw 23*c* transports the developing agent G in another direction (from left to right in FIG. 3). In other words, the first transport screw 23*b* and second transport screw 23*c* transport the developing agent G in opposite directions as shown in FIG. 3.

The toner T may adhere on the carrier C with a frictional effect when the toner T and carrier C are agitatingly mixed in the developing unit 23.

Such toner T and carrier C (i.e., developing agent G) are carried up to the developing roller 23*a* as developing agent G.

The developing agent G carried up on the developing roller 23*a* comes to a position facing the doctor blade 23*d* with a rotation of the developing roller 23*a*, wherein the doctor blade 23*d* is used to regulate an amount of developing agent G on the developing roller 23*a*.

Then, the developing agent G on the developing roller 23*a*, regulated to preferable amount by the doctor blade 23*d*, comes to a position facing the photoconductive drum 21.

At such position, the toner T in developing agent G adheres onto the electrostatic latent image formed on the photoconductive drum 21.

Specifically, an electric field is formed between the photoconductive drum 21 and developing roller 23*a* because an electric potential of electrostatic latent image, formed by irradiating the laser beam L on the photoconductive drum 21, and a developing bias potential applied to the developing roller 23*a* have a potential difference.

The toner T can be adhered to the electrostatic latent image with an effect of such potential difference between the photoconductive drum 21 and developing roller 23*a*.

The toner T adhered to the photoconductive drum 21 during the above-mentioned developing process is then transferred onto the intermediate transfer belt 27.

Then, the cleaning blade 25*a* and cleaning roller 25*b* recovers toners which remain on the photoconductive drum 21 in the cleaning unit 25.

The toner supply unit 32 includes a toner cartridge 33, and a toner transport unit (not shown), for example.

The toner cartridge 33 stores the toner T (e.g., yellow, magenta, cyan, and black toner), and is removable from the image forming apparatus 1.

The toner transport unit transports the toner T (i.e., fresh toner) from the toner cartridge 33 to the developing unit 23.

The toner transport unit (not shown) includes a toner transport route 34, and an air pump (not shown), for example. The air pump supplies an airflow into the toner transport route 34 to transport toner T with the airflow in the toner transport route 34.

The toner T in the toner cartridge 33 can be supplied to the developing unit 23, as required, through the toner supply port 23*f* when toners in the developing unit 23 are consumed by image forming operations.

As shown in FIGS. 2 and 3, the developing unit 23 includes the magnetic sensor 40 (i.e., toner concentration sensor) under the second transport screw 23*c* to detect a consumption rate of toners in the developing unit 23.

The developing unit 23 can also include a photosensor (not shown), which faces the photoconductive drum 21, to detect a consumption rate of toners in the developing unit 23.

If the magnetic sensor 40 or photosensor detects that a toner concentration in the developing unit 23 becomes lower than a target toner concentration, defined by a ratio of toner T in developing agent G, the toner T is supplied from the toner supply unit 32 to the developing unit 23 through the toner supply port 23*f* until the magnetic sensor 40 or photosensor detects that a toner concentration in the developing unit 23 becomes the target toner concentration.

The amount of toner T to be supplied to the developing unit 23 can be adjusted by controlling the operation time of the air pump.

The developing unit 23 employs a trickle developing method for toner and carrier supply.

As shown in FIG. 2, the developing unit 23 includes an ejection port 23*k* to eject a part of the developing agent G in the developing unit 23 to an outside of the developing unit 23.

As shown in FIG. 2, the image forming apparatus 1 includes a carrier supply unit 47, which supplies the carrier C (i.e., fresh carrier) to the developing unit 23.

Specifically, as shown in FIG. 2, the second agent compartment 23*h* is connected to the toner supply unit 32 and carrier supply unit 47.

The carrier supply unit 47 includes a carrier cartridge 48, and a carrier transport unit. The carrier cartridge 48 stores the carrier C (i.e., fresh carrier), and is removable from the image forming apparatus 1.

The carrier transport unit transports the carrier C (i.e., fresh carrier) from the carrier cartridge 48 to the developing unit 23 through a carrier supply port 23*m* shown in FIG. 2.

Figure 4:
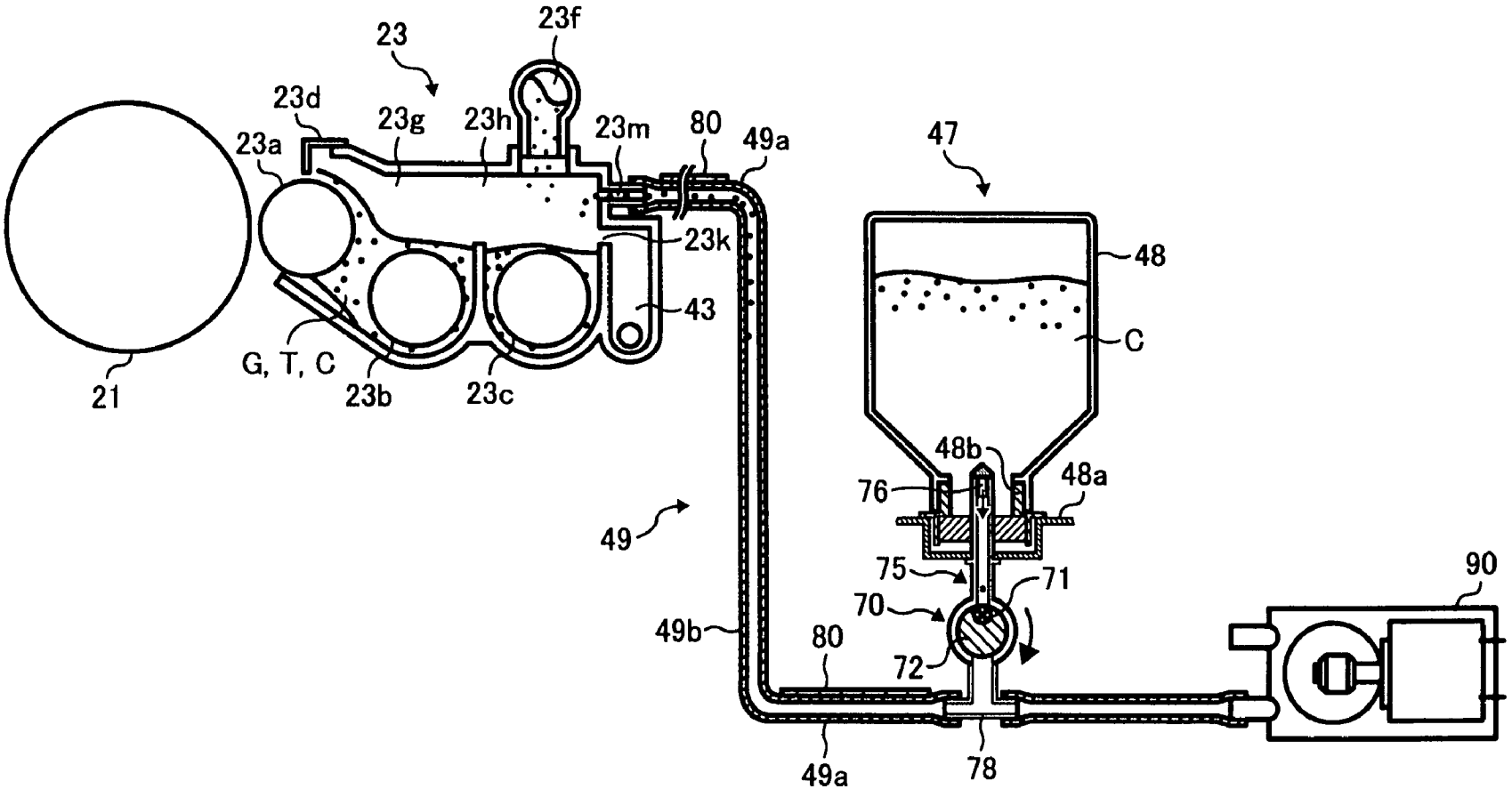
FIG. 4 is a schematic view of an agent transport unit according to an exemplary embodiment.

The carrier transport unit includes a carrier transport route 49, and an air pump 90 (see FIG. 4). The air pump 90 supplies airflow into the carrier transport route 49 to transport carriers with the airflow in the carrier transport route 49.

The configuration the carrier transport unit will be explained later in detail.

As shown in FIG. 2, the second agent compartment 23*h* includes the ejection port 23*k* at an upper wall portion of the second agent compartment 23*h*.

When the carrier supply unit 47 supplies the carrier C (i.e., fresh carrier) to the developing unit 23, the amount of the developing agent G in the developing unit 23 may exceed a target amount in the developing unit 23.

If such condition occurs, excessive developing agent G can be ejected outside the developing unit 23 from the ejection port 23*k*.

Such developing agent G ejected from the ejection port 23*k* is transported to an agent recovery unit 44 through a agent recovery route 43 as shown in FIG. 2.

Specifically, when the height of developing agent G in the second agent compartment 23*h* becomes higher than a height of the ejection port 23*k* during a supplying operation of carrier C (i.e., fresh carrier), the developing agent G starts to overflow from the ejection port 23*k*, by which the height of developing agent G in the developing unit 23 may be maintained at a given level.

In an exemplary embodiment, the developing agent is ejected from the developing unit 23 by an overflow method as above described. However, other methods can be conducted for ejecting the developing agent from the developing unit 23. For example, the ejection port 23*k* can be provided with a shutter, which can be opened and closed, by which the developing agent can be ejected from the developing unit 23 by opening and closing the shutter.

Hereinafter, a configuration of the carrier transport unit is explained in detail with reference to FIG. 4.

Hereinafter, the carrier transport unit is explained as a representative of agent transport unit. Therefore, the following exemplary embodiment can be similarly applied to an agent transport unit for transporting an agent such as toner, and two-component developing agent.

As shown in FIG. 4, the carrier transport unit includes the carrier transport route 49, and the air pump 90. The carrier transport unit further includes a nozzle 75, a carrier feeder 70, a joint unit 78, and a magnet 80 as magnetic field generator, for example.

The carrier transport route 49 can be made of material having good flexibility and anti-agent resistance, and has an inner diameter of 2 mm to 8 mm, for example.

The carrier transport route 49 can be made of an elastomer resin and rubber material such as polyurethane, nitrile, EPDM (ethylene propylene diene monomer), and silicon, for example.

Because the carrier transport route 49 is made of flexible material as above-mentioned and the carrier C is transported in the carrier transport route 49 with an airflow, the freedom of design layout for routing the carrier transport route 49 in the image forming apparatus 1 can be increased, by which a miniaturization of the image forming apparatus 1 may be achieved.

The carrier C can be transported by generating a relatively higher air pressure in the carrier transport route 49 by the air pump 90, by which the carrier C may be transported in a direction opposite to a gravity direction.

Therefore, the carrier cartridge 48 can be provided at a lower position with respect to a position of developing unit 23 in the image forming apparatus 1.

As shown in FIG. 4, a first end of the carrier transport route 49 is connected to the carrier supply port 23*m* of the developing unit 23, and a second end of the carrier transport route 49 is connected to the carrier cartridge 48 via the joint unit 78 and nozzle 75.

Furthermore, the second end of the carrier transport route 49 is connected to the air pump 90 via the joint unit 78 as shown in FIG. 4.

The nozzle 75 includes an opening end 76, through which the carrier C falls down in the nozzle 75 from the carrier cartridge 48 with gravity effect.

Such carrier C, having dropped down in the nozzle 75, is received by a concave portion 71 formed in a rotatable member 72 of the carrier feeder 70.

As shown in FIG. 4, the rotatable member 72 can be rotated in a direction shown by an arrow with a motor (not shown). When the rotatable member 72 rotates in a direction shown by the arrow in FIG. 4, the carrier C held in the concave portion 71 falls down to the joint unit 78 with gravity effect.

With such configuration, a given amount of carrier C can be supplied to the joint unit 78, connected to the carrier transport route 49, by the carrier feeder 70.

Then, the carrier C can be transported in the carrier transport route 49 with airflow supplied to the joint unit 78 from the air pump 90.

The carrier C may receive little stress during the transportation of carrier C in the carrier transport route 49 because the carrier transport route 49 may not include an object such as screw inside the carrier transport route 49, which is different from a conventional agent transport unit using a coil screw for carrier transportation.

The carrier feeder 70 can prevent an inflow of air into the carrier cartridge 48 when the air pump 90 supplies airflow to the joint unit 78.

The carrier cartridge 48 can be made of resin material, and shaped in a bottle shape or bag shape.

As shown in FIG. 4, the carrier cartridge 48 includes a sealing member 48*a*, and a mouthpiece 48*b*.

The mouthpiece 48*b* is adhered on a mouth of the carrier cartridge 48, and the sealing member 48*a* seals the mouthpiece 48*b*. The sealing member 48*a* can be made of material such as foamed polyurethane, and rubber, for example.

The nozzle 75 can be inserted into the carrier cartridge 48 via the sealing member 48*a*, which seals the carrier cartridge 48 from the outside atmosphere, by which a leakage of carrier C from the carrier cartridge 48 may be prevented.

The carrier supply unit 47, including the carrier transport unit and carrier cartridge 48, can be operated as below.

A control unit in the image forming apparatus 1 transmits a signal to the carrier feeder 70, which instruct a rotation of the rotatable member 72 in a direction shown by an arrow in FIG. 4.

When the concave portion 71 of the rotatable member 72 comes to a lowest position with a rotation of the rotatable member 72, the carrier C held in the concave portion 71 falls down to the joint unit 78.

Then, the carrier C, having dropped down to the joint unit 78, is transported in the carrier transport route 49 with airflow from the air pump 90.

In case of a configuration shown in FIG. 4, the carrier C is transported in the carrier transport route 49 along a horizontal route 49*a*, a vertical route 49*b*, and horizontal route 49*a*, and then supplied to the developing unit 23 from the carrier supply port 23*m*.

Before the carrier C falls down to the joint unit 78 from the carrier feeder 70, the air pump 90 starts to supply airflow to the carrier transport route 49.

By supplying airflow in the carrier transport route 49 in such a manner, the carrier C can be dispersed in the carrier transport route 49 more easily, and can be transported in the carrier transport route 49 with a relatively smaller amount of airflow (or at a slower air speed), by which energy consumption of the air pump 90 can be made smaller. Accordingly, the amount of airflow to be supplied by the air pump 90 can be reduced.

In an exemplary embodiment, the air speed set by the air pump 90 is in a range of 0.5 m/sec to 5 m/sec, for example.

Figure 10:
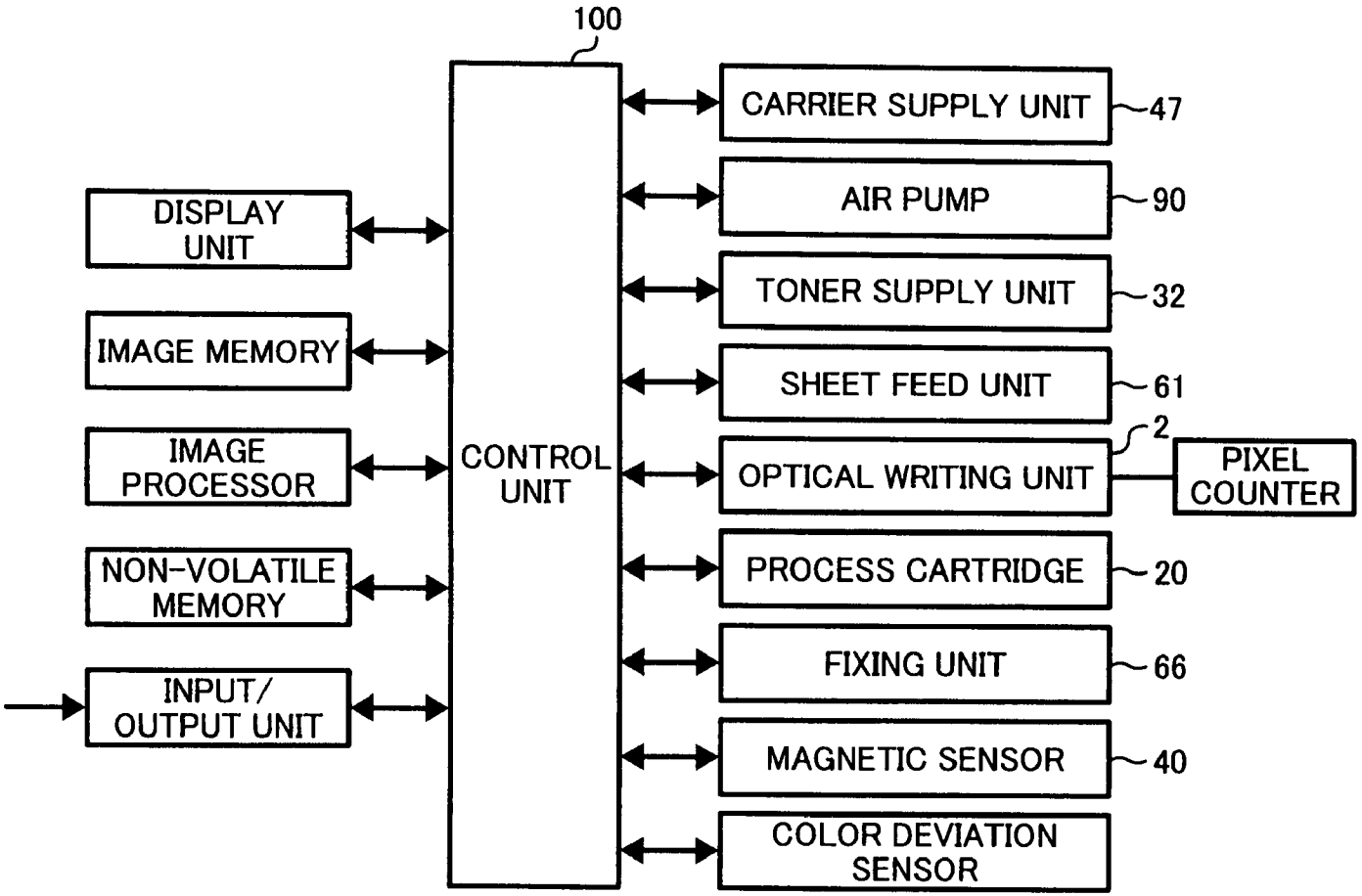
FIG. 10 is a block diagram for a control unit in an image forming apparatus in FIG. 1.

As shown in FIG. 10, the image forming apparatus 1 includes a control unit 100 to control the carrier feeder 70, carrier supply unit 47, and air pump 90, and other units, as required.

As shown in FIG. 4, the carrier transport route 49 includes a horizontal route 49*a* and a vertical route 49*b* to transport the carrier C with a gas flow (e.g., airflow) supplied from the air pump 90. In other words, the carrier transport route 49 shown in FIG. 4 does not include an inclined route.

If an inclined route having a larger inclination angle is provided in the carrier transport route 49, carriers accumulated in the inclined route may slide down the inclined route with its self-weight effect, and may be piled up at a bottom of the inclined route, and, resultantly, the carrier transport route 49 may be choked at the inclined route.

Such sliding down of the carrier may occur when an inclination angle of the inclined route becomes greater than a repose angle of the carrier C. Specifically, the carrier C may slide down the inclined route with its self-weight effect.

Therefore, as for the carrier transport route 49 in FIG. 4, the carrier C can be effectively and efficiently transported from a lower to higher position without choking the carrier transport route 49 because the inclined route, which may be more likely to cause choking of carrier transport route 49, is not included in a configuration shown in FIG. 4.

Furthermore, the carrier C may receive little stress in a configuration shown in FIG. 4 compared to a carrier transport unit using a coil screw for carrier transportation because the carrier C is transported in the carrier transport route 49 with airflow.

Furthermore, the configuration shown in FIG. 4 may increase the freedom of design layout for routing the carrier transport route 49, by which a miniaturization of the image forming apparatus 1 may be achieved.

A transportation condition of carrier C in the carrier transport route 49 differs between the horizontal route 49*a* and vertical route 49*b*.

Figure 5:
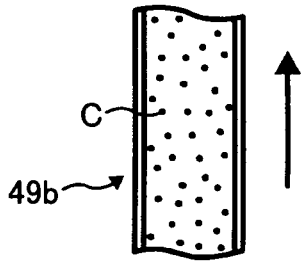
FIG. 5 is a cross-sectional view of a vertical route in a transport route in an agent transport unit according to an exemplary embodiment.

When the carrier C is transported in the vertical route 49*b*, the carrier C may be dispersed uniformly across a cross-section area of the vertical route 49*b* as shown in FIG. 5 because forces acting to the carrier C may be aligned into an same vertical direction, wherein such forces include an airflow pressure and gravity force.

As such, the carrier C can be transported in the vertical route 49*b* while dispersed uniformly with airflow.

The vertical route 49*b* includes a substantially vertical route, which may be slightly inclined from a vertical direction.

Figure 6:
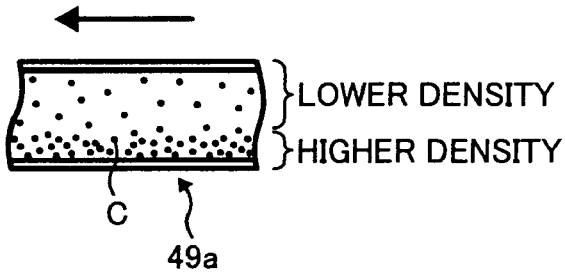
FIG. 6 is a cross-sectional view of a horizontal route in a transport route in an agent transport unit according to an exemplary embodiment.

On one hand, when the carrier C is transported in the horizontal route 49*a* of carrier transport route 49, the carrier C may not be dispersed uniformly across a cross-section area of the horizontal route 49*a* as shown in FIG. 6 because the gravity force acting to the carrier C is perpendicular to a direction of airflow.

If the gravity force and airflow act on the carrier C as shown in FIG. 6, a force vector composed of gravity force and airflow directs to a downward direction, by which the carrier C may not be dispersed uniformly across a cross-section area of the horizontal route 49*a* as shown in FIG. 6.

Specifically, the density of carrier C in a lower cross-section area of the horizontal route 49*a* may become greater than the density of carrier C in a upper cross-section area of the horizontal route 49*a* if the amount of carrier C becomes too much with respect to amount of airflow, or if the air speed becomes too slow.

In such a case, some of the carrier C may land on a bottom wall of the horizontal route 49*a*, and may not float again due to a friction between the landed carrier C and bottom wall of the horizontal route 49*a*, and the landed carrier C may remain and accumulate on the bottom wall of the horizontal route 49*a*.

Such accumulation may be prevented by increasing the air speed in the carrier transport route 49, or by decreasing the weight mixing ratio of carrier C versus the airflow.

However, if the air speed is increased too fast, an internal pressure in the developing unit 23 may become too high, by which toner scatting may unfavorably occur. Furthermore, if the air speed is increased too fast, the air pump 90 may unfavorably increase its size.

Furthermore, if the weight mixing ratio is set too low, the transport efficiency of the carrier C may become too low. In such a case, the carrier feeder 70, carrier supply unit 47, and air pump 90, and other units may need to be activated for a longer time period to compensate for the effect of a too-small weight mixing ratio. However, such method may result in an increase in energy consumption in the image forming apparatus 1, which is not a favorable phenomenon.

Furthermore, if the weight mixing ratio is set too low, the carrier C may not be sufficiently supplied to each of the developing units from one carrier supply unit.

Therefore, the carrier C may need to be efficiently transported in the carrier transport route 49 with a relatively lower air speed (i.e., with small amount of airflow).

If the carrier C accumulates on a bottom wall of the horizontal route 49*a* of carrier transport route 49, such carrier-accumulated area may reduce the cross-section area, which can be used for carrier transportation.

If such area-reduction occurs, the air speed at such carrier-accumulated area may be increased based on Bernoulli's principle.

With such increased air speed at the accumulated area in the horizontal route 49*a*, the carrier C may flow through a portion having the carrier-accumulated area, by which an amount of carrier C to be accumulated in the horizontal route 49*a* may not exceed a given amount.

Therefore, even if some carrier accumulates on the bottom wall of the horizontal route 49*a*, such accumulation may not cause a choking of the horizontal route 49*a* of the carrier transport route 49.

Accordingly, the carrier C may be effectively transported in the horizontal route 49*a* even if such accumulated area may occur in the horizontal route 49*a*.

Figure 7:
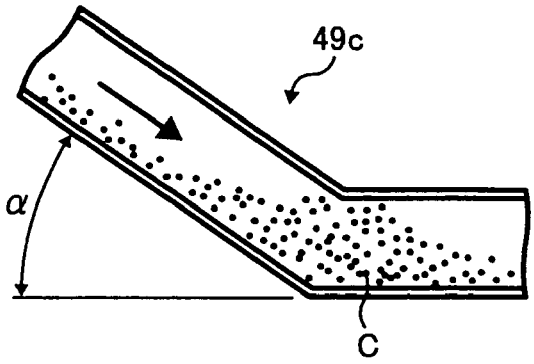
FIG. 7 is a cross-sectional view of an inclined route in a transport route in an agent transport unit according to an exemplary embodiment.

However, if the carrier transport route 49 has a inclined route 49*c*, which has a inclination angle of α as shown in FIG. 7, accumulated carrier C may slide downward with gravity effect and may be piled up at an inflection portion as shown in FIG. 7, by which the carrier transport route 49 may be choked. Such choking condition will be explained later with reference to FIG. 7.

In general, a carrier accumulation and resultant choking of the carrier transport route 49 can be explained as below.

The carrier transport unit transports the carrier C little by little. The carrier transport route 49 may be choked with the carrier C when a supply of airflow is stopped.

As for the horizontal route 49*a* and inclined route 49*c*, the density of carrier C in a cross-section area in the horizontal route 49*a* or inclined route 49*c* may become uneven when the carrier C is transported in the horizontal route 49*a* or inclined route 49*c*.

Specifically, a higher density portion and a lower density portion of carrier C may be observed in a cross-section area in the horizontal route 49*a* or inclined route 49*c* when an airflow is supplied into the horizontal route 49*a* or inclined route 49*c*.

Accordingly, when such airflow is supplied into the horizontal route 49*a* or inclined route 49*c*, the carrier C may accumulate in the horizontal route 49*a* or inclined route 49*c*.

In case of horizontal route 49*a*, such accumulated carrier C may still remain on such accumulated portion when a supply of airflow is stopped. However, as above explained, the horizontal route 49*a* may not be choked by such accumulated carrier C.

In case of inclined route 49*c*, such accumulated carrier C may slide downward along the inclined route 49*c*, and may be piled up at an inflection portion when an airflow supply is stopped. Accordingly, the inclined route 4 in the carrier transport route 49 may be choked by the carrier C.

In case of vertical route 49*b*, the carrier C may flow uniformly in the vertical route 49, and the carrier C supplied in the vertical route 49*b* can be transported effectively in the vertical route 49*b* with the airflow. Accordingly, the vertical route 49*b* may not be choked by the carrier C when a supply of airflow is stopped.

Hereinafter, a transport route pattern and the distance from a first point A to a second point B in the carrier transport unit is considered with reference to FIGS. 8A and 8B.

Figure 8A:
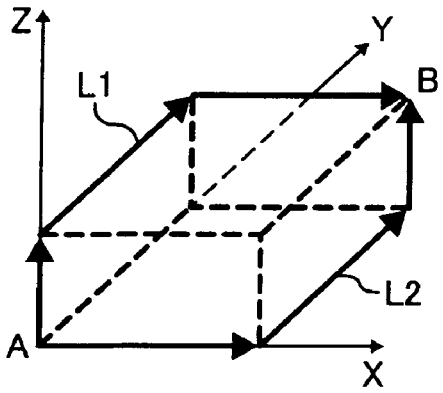
FIGS. 8A and 8B are schematic views showing patterns of transport routes for transporting an agent.
Figure 8B:
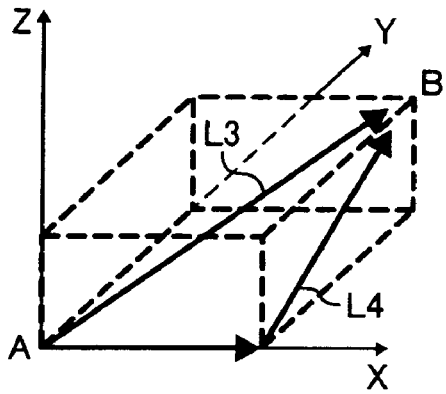

As shown in FIG. 8B, if the first point A and second point B are connected with one straight transport route, indicated by a route L3, the transport distance between the first point A and second point B becomes the shortest, by which the cost of the transport route can be decreased, and the amount of airflow to be used in the route L3 can be reduced.

However, such route L3 is inclined with respect to a horizontal direction, and may cause choking of the transport route as above-described.

A route L4 may also cause a choking of the transport route in a similar manner because the route L4 also includes an inclined route.

On one hand, FIG. 8A shows routes L1 and L2 to connect the first point A and second point B with a horizontal route and vertical route without an inclined route. Accordingly, the transport route may not be choked if such routes L1 or L2 are used in the transport route.

Although the inclined route 49*c* may cause choking of carrier transport route 49 as shown in FIG. 7, such choking of carrier transport route 49 can be prevented by setting an inclination angle a to a repose angle equal to or less than that of carrier C.

A repose angle of carrier C can be measured by using "Powder Characteristics Tester" available from HOSOKAWA MICRON CORPORATION.

Specifically, powder particles (e.g., carriers) are dropped on a horizontal face to form a mountain of powder particles. The slope angle of mountain with respect to the horizontal face is measured and defined as repose angle of powder particles (e.g., carriers).

Accordingly, the powder particles (e.g., carriers) may not slide down the mountain if the actual slope angle is a repose angle equal to or less than that of the powder particles (e.g., carriers). For example, if the powder particles (e.g., carriers) have poor fluidity, the repose angle of particles (e.g., carriers) may become greater.

Therefore, if the inclination angle α of the inclined route 49*c* is set to a repose angle equal to or less than that of carrier C, choking of carrier transport route 49 may be prevented because the carrier C accumulated in the inclined route 49*c* may not slide down a slope of the inclined route 49*c*, and thereby the accumulated carrier C may not be piled up at a bottom of the inclined route 49*c*.

If the carrier C does not choke the inclined route 49*c*, an airflow condition in the inclined route 49*c* may become a similar airflow condition in the horizontal route 49*a*, which is explained in the above with the Bemoulli's principle.

Therefore, as for an exemplary embodiment, the carrier transport unit may include the air pump 90 and the carrier transport route 49, wherein the carrier transport route 49 may include at least one of the horizontal route 49*a*, vertical route 49*b*, and inclined route 49*c*, or a combination of at least two of them.

In other words, if the carrier transport route 49 can be composed at least one of the horizontal route 49*a*, vertical route 49*b*, and inclined route 49*c* according to an exemplary embodiment, choking of carrier transport route 49 may be effectively prevented.

Figure 9:
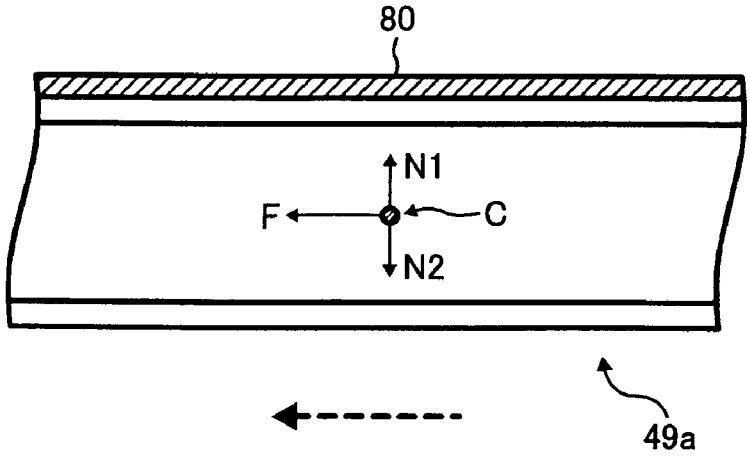
FIG. 9 is a cross-sectional view of a horizontal route in a transport route having a magnetic field generator.

As shown in FIGS. 4 and 9, the magnet 80 may be disposed over the horizontal route 49*a* of the carrier transport route 49 as magnetic field generator.

With such configuration, an accumulation of carrier C on a bottom wall of the horizontal route 49*a* may be reduced.

Specifically, the carrier C moving in a horizontal direction (i.e., direction of dotted arrow in FIG. 9) receives a force F from airflow, a gravity force N2, an magnetic force N1 from the magnet 80 as shown in FIG. 9.

The force F moves the carrier C in a horizontal direction.

The gravity force N2 acts on the carrier C in gravity direction.

The magnetic force N1 acts on the carrier C in an upward direction.

Accordingly, the gravity force N2 may be somehow offset by the magnetic force N1, by which the carrier C may be dispersed more uniformly across a cross-section area of the horizontal route 49*a*, and the carrier C may move in the horizontal route 49*a* while dispersed more uniformly across a cross-section area of the horizontal route 49*a*.

The magnet 80 can be disposed over the inclined route 49*c*. As similar to the horizontal route 49*a*, the carrier C may be dispersed more uniformly across a cross-section area of the inclined route 49*c*, and the carrier C may move in the inclined route 49*c* while dispersed more uniformly across a cross-section area of the inclined route 49*c*.

Furthermore, an electromagnet can be used instead of the magnet 80 as magnetic field generator.

As above described, the image forming apparatus 1 includes the carrier transport unit, which transports the carrier C with gas flow (e.g., airflow) from the air pump 90. The carrier transport unit includes the carrier transport route 49, which includes at least one of the horizontal route 49*a*, vertical route 49*b*, and inclined route 49*c* inclined with a repose angle equal to or less than that of carrier C, or a combination of at least two of them.

With such configuration, the carrier C to be supplied to the developing unit 23 may not be degraded by a mechanical (or physical) stress when the carrier C is transported in the carrier transport route 49, and the carrier C may be effectively and efficiently transported in the carrier transport route 49 without choking the carrier transport route 49. Furthermore, the configuration shown in FIG. 4 may increase the freedom of design layout for routing the carrier transport route 49, by which miniaturization of the image forming apparatus 1 may be achieved.

In the above discussion, the carrier supply unit 47 supplies the carrier C (i.e., fresh carrier), however, the carrier supply unit 47 can be configured to supply the two-component developing agent G, in which the carrier transport unit transports the two-component developing agent G, and a similar effect as in the carrier transportation may be obtained.

Specifically, when an agent transport unit has a similar configuration as in the carrier transport unit explained with FIG. 4, and the agent transport unit includes an transport route having at least one of a horizontal route, vertical route, and inclined route inclined with a repose angle equal to or less than that of the agent as similar to the configuration explained in the above, such agent transport unit may transport an agent having magnetic component in a similar manner as in the above-discussed carrier transport unit.

In the above discussion, the carrier transport unit is used to explain an exemplary embodiment, however, the configuration for the above-discussed carrier transport unit can be applied to the toner transport unit of the toner supply unit 32 similarly.

Specifically, such toner transport unit may include the toner transport route 34 including at least one of a horizontal route, a vertical route, and an inclined route inclined with a repose angle equal to or less than that of toner T, or a combination of at least two of them. Accordingly, such toner transport unit may have a similar effect as in the above-discussed carrier transport unit.

Accordingly, the toner T to be supplied to the developing unit 23 may not be degraded by a mechanical (or physical) stress when the toner T is transported in the toner transport route 34, and the toner T may be effectively and efficiently transported in the toner transport route 34 without choking the toner transport route 34. Furthermore such configuration for toner transport route 34 may increase a freedom of design layout for routing the toner transport route 34, by which miniaturization of the image forming apparatus 1 may be achieved.

In the above discussion, the air pump 90 is used to supply a gas flow (e.g., airflow) to the carrier transport route 49, however, other types of pump (e.g., screw pump) can be used to supply a gas flow (e.g., airflow) to the carrier transport route 49.

In the above-discussed exemplary embodiment, each of the process cartridges 20Y, 20M, 20C, and 20BK integrally includes the photoconductive drum 21, charger 22, and cleaning unit 25, and each of the developing units 23Y, 23M, 23C, and 23BK is a separate component with respect to the process cartridges 20Y, 20M, 20C, and 20BK.

However, each of the process cartridges 20Y, 20M, 20C, 20BK can also integrally include each of the developing units 23Y, 23M, 23C, and 23BK.

Specifically, the process cartridge 20 may include the photoconductive drum 21, charger 22, developing unit 23, and cleaning unit 25. By integrating the developing unit 23 with the process cartridge 20, maintenance work of the image forming section can be improved.

Hereinafter, a control process for controlling the carrier transport unit is explained with reference to FIG. 11.

Figure 11:
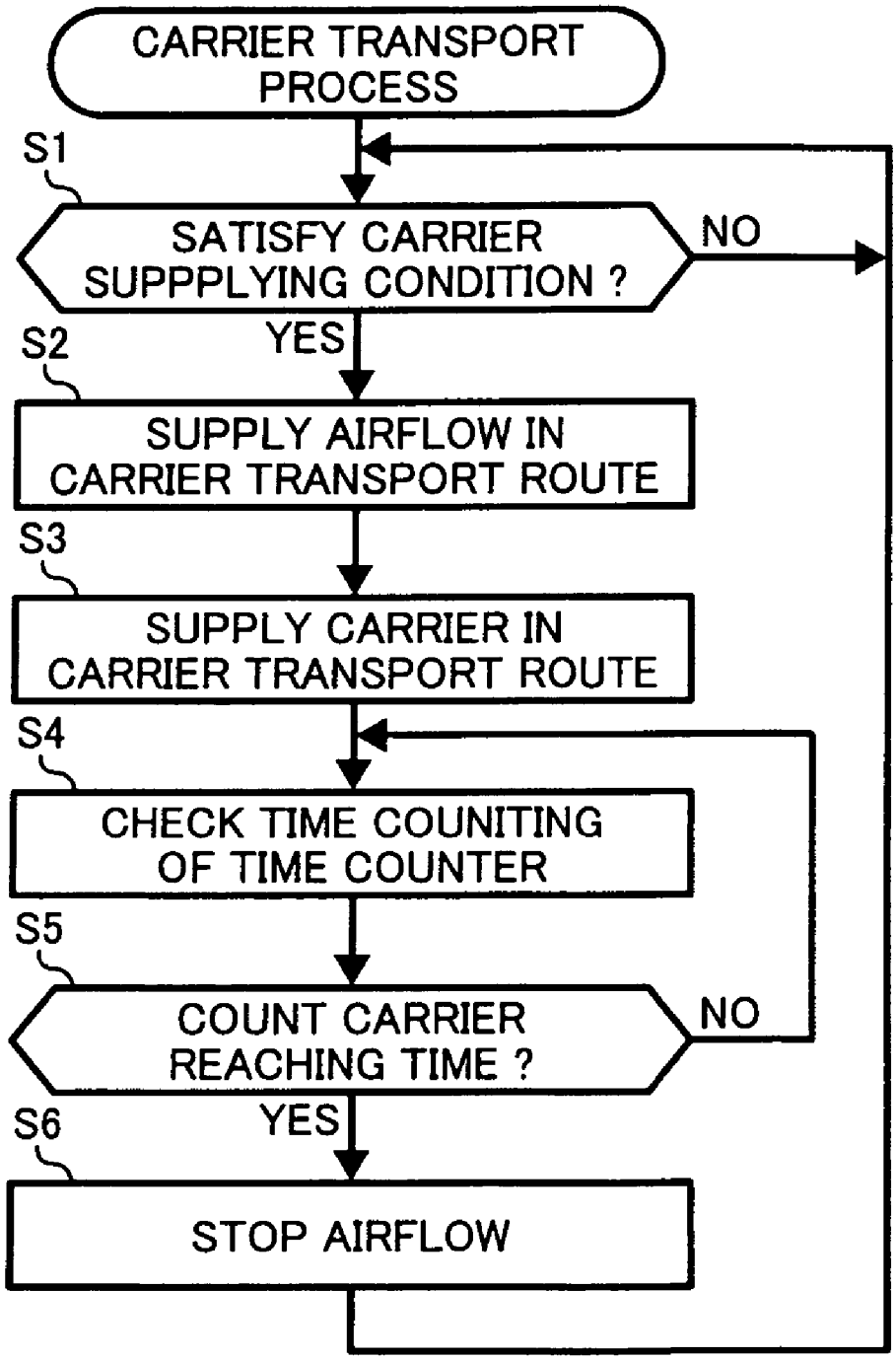
FIG. 11 is a flowchart explaining a control process for controlling an agent transport unit.

FIG. 11 is a flowchart explaining a control process to be conducted for the carrier transport unit according to an exemplary embodiment.

As shown in FIG. 11, when determining when to supply the carrier C to the developing unit 23 by the carrier transport unit, the control unit 100 judges whether conditions for supplying the carrier C have satisfied or not at step S1.

Specifically, at step S1, the control unit 100 checks conditions such as toner consumption amount in the developing unit 23, number of printed sheets, operating time of the developing unit 23, for example. In other words, the control unit 100 checks whether the developing agent G in the developing unit 23 has degraded or not.

If the control unit 100 judges that conditions for supplying the carrier C have not been satisfied (i.e., No at step S1), the process does not go forward.

If the control unit 100 judges that conditions for supplying the carrier C have satisfied (i.e., Yes at step S1), the control unit 100 activates the air pump 90 to supply airflow into the carrier transport route 49 at step S2.

At step S3, the control unit 100 activates the carrier feeder 70 to supply the carrier C into the carrier transport route 49.

At step S4, the control unit 100 checks a time counting with a time counter provided in the control unit 100. Specifically, the time counter counts the carrier reaching time, wherein the carrier reaching time is a time from the activation of air pump 90 to a reaching of the carrier C (i.e., fresh carrier) to the developing unit 23.

Such carrier reaching time can be determined with experiments in advance.

In general, the carrier C moves in the carrier transport route 49 with a speed, which is approximately 70% of an air speed in the carrier transport route 49. Accordingly, the carrier reaching time becomes longer than an air reaching time, wherein the air reaching time is a time from the activation of air pump 90 to a reaching of airflow to the developing unit 23.

At step S5, the control unit 100 checks whether the time counter counts the carrier reaching time.

If the control unit 100 checks that the time counter does not yet count the carrier reaching time, the control unit 100 judges that the carrier C has not reached the developing unit 23, and then the process goes back to step S4.

If the control unit 100 checks that the time counter has counted the carrier reaching time, the control unit 100 judges that the carrier C has reached the developing unit 23, and then the control unit 100 deactivates the air pump 90 to stop a supply of airflow into the carrier transport route 49 at step S6.

With such control process, the supply of airflow into the carrier transport route 49 by the air pump 90 may be continued until a transportation of the carrier C to the developing unit 23 has been completed and the control unit 100 has confirmed the completion of the transportation of the carrier C.

Accordingly, the carrier C transported in the carrier transport route 49 may reach the developing unit 23 when the control unit 100 has confirmed the completion of the transportation of the carrier C. Therefore, the carrier transport route 49 may not be choked when the supply of airflow into the carrier transport route 49 is stopped.

Hereinafter, a carrier transport unit according to another exemplary embodiment is explained with reference to FIG. 12.

Figure 12:
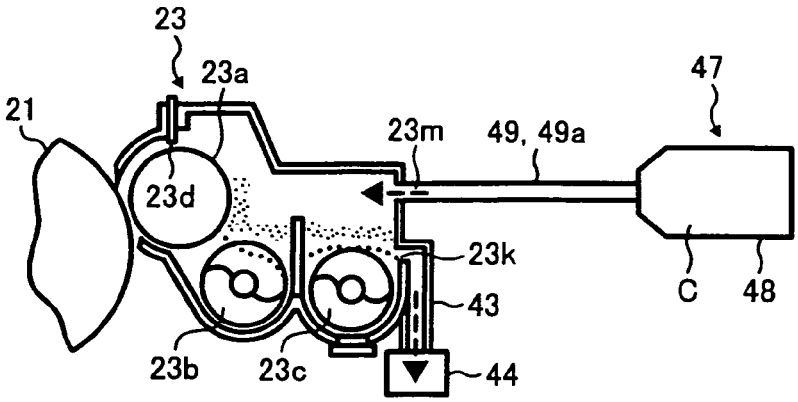
FIG. 12 is a schematic view of an agent transport unit according to another exemplary embodiment.

FIG. 12 is a schematic view of a carrier transport unit according to another exemplary embodiment.

The carrier transport unit shown in FIG. 12 includes the carrier transport route 49 having only the horizontal route 49*a*, which is different from a configuration shown in FIG. 4.

In FIG. 12, the air pump 90, toner supply unit 32, and other parts are omitted from the drawing.

As similar to previous exemplary embodiment, the carrier C to be supplied to the developing unit 23 may not be degraded by a mechanical (or physical) stress when the carrier C is transported in the horizontal route 49*a*, and the carrier C may be effectively and efficiently transported in the horizontal route 49*a* without choking the horizontal route 49*a*. Furthermore, the configuration shown in FIG. 12 may increase the freedom of design layout for routing the carrier transport route 49, by which a miniaturization of the image forming apparatus 1 may be achieved.

Hereinafter, a carrier transport unit according to another exemplary embodiment is explained with reference to FIG. 13.

Figure 13:
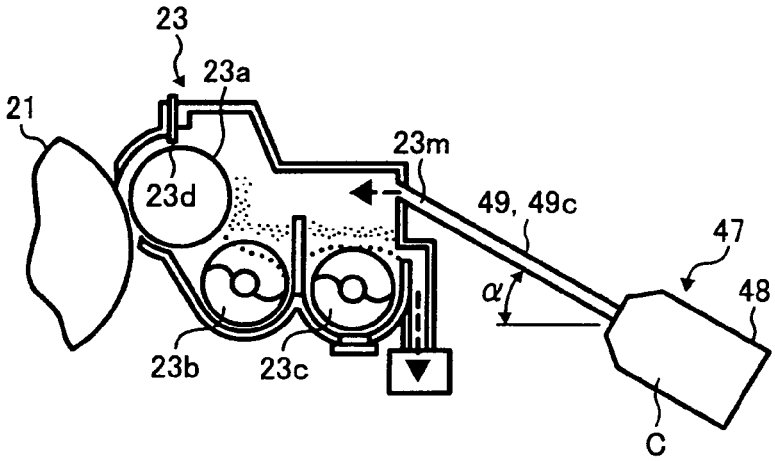
FIG. 13 is a schematic view of an agent transport unit according to another exemplary embodiment.

FIG. 13 is a schematic view of a carrier transport unit according to another exemplary embodiment.

The carrier transport unit shown in FIG. 13 includes the carrier transport route 49 having only the inclined route 49*c* inclined at a repose angle equal to or less than that of carrier C, which is different from a configuration shown in FIG. 4.

An inclination angle $\alpha$ of the inclined route 49*c* is set to a repose angle equal to or less than that of carrier C. In FIG. 13, the air pump 90, toner supply unit 32, and other parts are omitted from the drawing.

As similar to previous exemplary embodiments, the carrier C to be supplied to the developing unit 23 may not be degraded by a mechanical (or physical) stress when the carrier C is transported in the inclined route 49*c*, and the carrier C may be effectively and efficiently transported in the inclined route 49*c* without choking the inclined route 49*c*. Furthermore, the configuration shown in FIG. 13 may increase the freedom of design layout for routing the carrier transport route 49, by which miniaturization of the image forming apparatus 1 may be achieved.

Hereinafter, a carrier transport unit according to another exemplary embodiment is explained with reference to FIG. 14.

Figure 14:
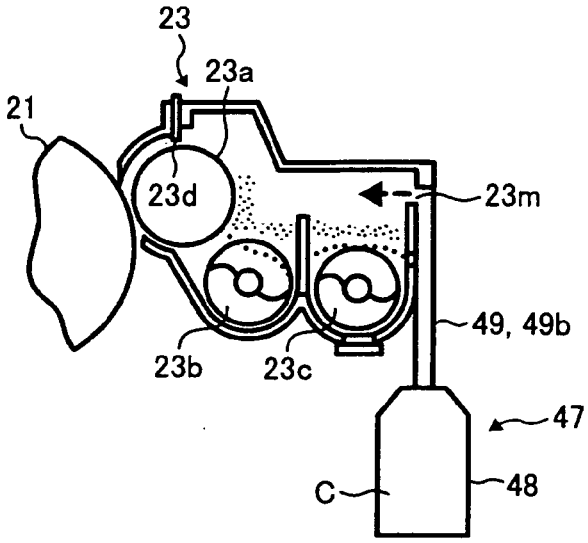
FIG. 14 is a schematic view of an agent transport unit according to another exemplary embodiment.

FIG. 14 is a schematic view of a carrier transport unit according to another exemplary embodiment.

The carrier transport unit shown in FIG. 14 includes the carrier transport route 49 having only the vertical route 49*b*, which is different from a configuration shown in FIG. 4.

In FIG. 14, the air pump 90, toner supply unit 32, and other parts are omitted from the drawing.

As similar to previous exemplary embodiments, the carrier C to be supplied to the developing unit 23 may not be degraded by a mechanical (or physical) stress when the carrier C is transported in the vertical route 49*b*, and the carrier C may be effectively and efficiently transported in the vertical route 49*b* without choking the vertical route 49*b*. Furthermore, a configuration shown in FIG. 14 may increase a freedom of design layout for routing the carrier transport route 49, by which a miniaturization of the image forming apparatus 1 may be achieved.

Hereinafter, a carrier transport unit according to another exemplary embodiment is explained with reference to FIG. 15.

Figure 15:
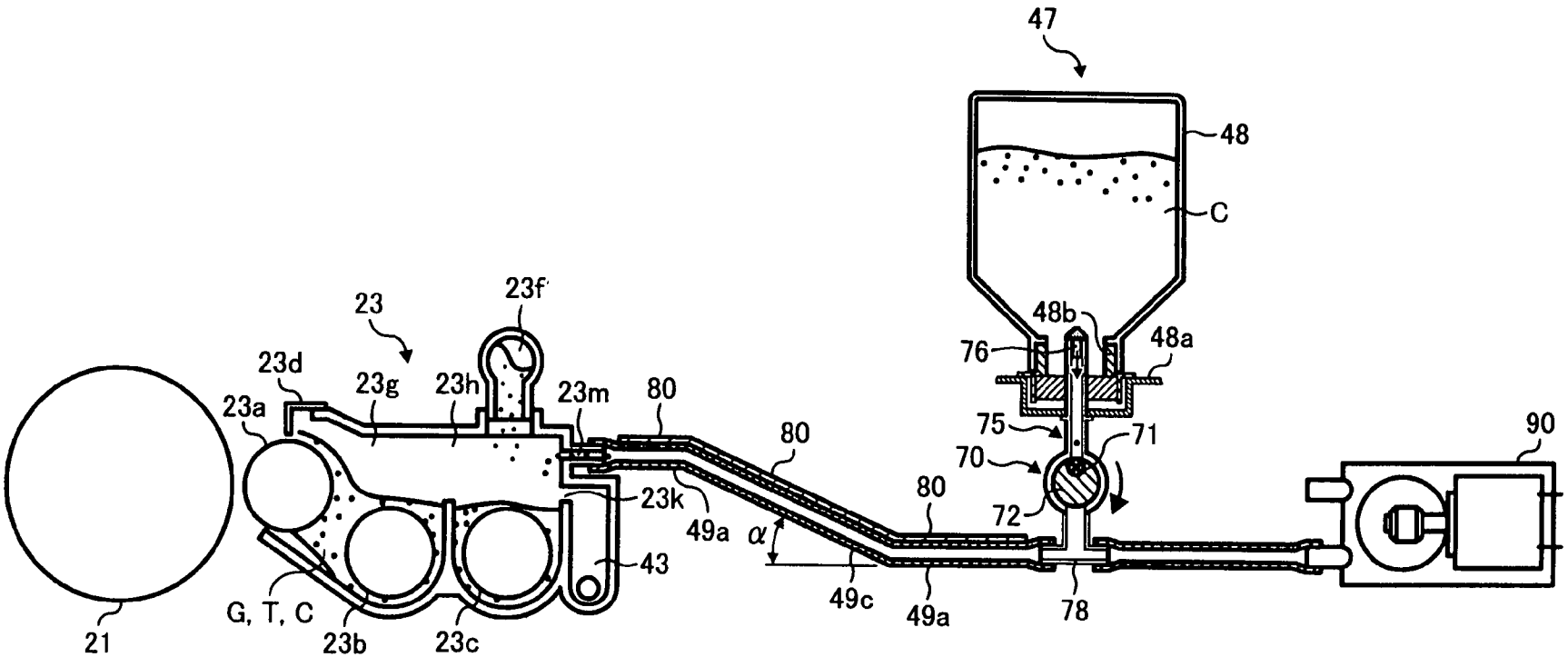
FIG. 15 is a schematic view of an agent transport unit according to another exemplary embodiment.

FIG. 15 is a schematic view of a carrier transport unit according to another exemplary embodiment.

The carrier transport unit shown in FIG. 15 includes the carrier transport route 49 having the horizontal route 49*a* and inclined route 49*c*, which is different from a configuration shown in FIG. 4.

An inclination angle $\alpha$ of the inclined route 49*c* is set to a repose angle equal to or less than that of carrier C.

Furthermore, as shown in FIG. 15, the magnet 80 (i.e., magnetic field generator) is disposed over the entire upper portion of the carrier transport route 49 (e.g., from a portion most upstream to a portion most downstream of the carrier transport route 49).

With such configuration, the carrier C may be dispersed more uniformly across a cross-section area of horizontal route 49*a* and inclined route 49*c*, by which the carrier C may be transported more effectively and efficiently in the carrier transport route 49.

As similar to previous exemplary embodiments, the carrier C to be supplied to the developing unit 23 may not be degraded by a mechanical (or physical) stress when the carrier C is transported in the horizontal route 49*a* and inclined route 49*c*, and the carrier C may be effectively and efficiently transported in the horizontal route 49*a* and inclined route 49*c* without choking the horizontal route 49*a* and inclined route 49*c*. Furthermore, the configuration shown in FIG. 15 may increase the freedom of design layout for routing the carrier transport route 49, by which miniaturization of the image forming apparatus 1 may be achieved.

Numerous additional modifications and variations are possible in light of the above teachings. It is therefore to be understood that within the scope of the appended claims, the disclosure of the present invention may be practiced otherwise than as specifically described herein.

This application claims priority from Japanese patent applications No. 2005-255784 filed on Sep. 5, 2005 and No. 2006-172799 filed on Jun. 22, 2006 in the Japan Patent Office, the entire contents of which are hereby incorporated by reference herein.

The invention claimed is:

1. An agent transport unit for transporting an agent from a first container to a second container, the agent transport unit comprising:

a transport route which connects the first container and second container; and a pump which supplies a gas flow into the transport route to transport the agent in the transport route, wherein the transport route includes a first route which extends in a substantially horizontal direction, and wherein a magnetic field generator which generates a magnetic field over an upper portion of the first route is disposed on an outer surface of the upper portion of the first route.

2. The agent transport unit according to claim 1, wherein the transport route transports the agent from the first container to the second container.

3. The agent transport unit according to claim 1, wherein the agent includes any one of a carrier, a toner, and a developing agent composed of carrier and toner.

4. The agent transport unit according to claim 3, wherein the second container includes a developing unit, which develops a latent image, formed on an image carrying member in an image forming apparatus, with the agent transported from the first container.

5. The agent transport unit according to claim 4, wherein the developing unit includes an ejector which ejects a part of the agent to a position outside the developing unit.

6. The agent transport unit according to claim 1, wherein the transport route includes a second route which extends in a substantially vertical direction.

7. The agent transport unit according to claim 1, wherein the transport route includes a third route which extends in a substantially inclined direction at a repose angle which is equal to or less than a repose angle of the agent.

8. The agent transport unit according to claim 7, wherein a magnetic field generator which generates a magnetic field over an upper portion of the third route is disposed on an outer surface of the upper portion of the third route.

9. An image forming apparatus, comprising:

a first container which stores an agent;

a second container which receives the agent;

a transport route which connects the first container and second container;

and a pump which supplies a gas flow into the transport route to transport the agent in the transport route, wherein the transport route includes a first route which extends in a substantially horizontal direction, and wherein a magnetic field generator which generates a magnetic field over an upper portion of the first route is disposed on an outer surface of the upper portion of the first route.

10. The image forming apparatus according to claim 9, wherein the transport route transports the agent from the first container to the second container.

11. The image forming apparatus according to claim 9, wherein the agent includes any one of a carrier, a toner, and a developing agent composed of carrier and toner.

12. The image forming apparatus according to claim 11, wherein the second container includes a developing unit, which develops a latent image, formed on an image carrying member in an image forming apparatus, with the agent transported from the first container.

13. The image forming apparatus according to claim 12, wherein the developing unit includes an ejector which ejects a part of the agent to a position outside the developing unit.

14. The image forming apparatus according to claim 9, wherein the transport route includes a second route which extends in a substantially vertical direction.

15. The image forming apparatus according to claim 9, wherein the transport route includes a third route which extends in a substantially inclined direction at a repose angle which is equal to or less than a repose angle of the agent.

16. A method of transporting an agent from a first container to a second container through a transport route, the method comprising:

determining if supplying the agent to the second container is required based on operating parameters;

supplying a gas flow into the transport route;

placing the agent in the transport route from the first container;

transporting the agent in the transport route with the gas flow;

counting a time period for transporting the agent from the first container to the second container; and stopping a supply of the gas flow into the transport route, wherein the transport route includes a first route which extends in a substantially horizontal direction, and wherein a magnetic field generator which generates a magnetic field over an upper portion of the first route is disposed on an outer surface of the upper portion of the first route.

17. The method according to claim 16, wherein the agent includes any one of a carrier, a toner, and a developing agent composed of carrier and toner.

18. The method according to claim 17, wherein the second container includes a developing unit, which develops a latent image, formed on an image carrying member in an image forming apparatus, with the agent transported from the first container.

19. The method according to claim 18, wherein the developing unit includes an ejector which ejects a part of the agent to an outside of the developing unit.

20. The method according to claim 16, wherein the transport route includes a second route which extends in a substantially vertical direction.

* * * * *